US006176301B1

(12) United States Patent
Bennett et al.

(10) Patent No.: US 6,176,301 B1
(45) Date of Patent: Jan. 23, 2001

(54) HEAT TRANSFER TUBE WITH CRACK-LIKE CAVITIES TO ENHANCE PERFORMANCE THEREOF

(75) Inventors: Donald L. Bennett, Franklin, KY (US); Liangyou Tang, Cottontown, TN (US)

(73) Assignee: Outokumpu Copper Franklin, Inc., Franklin, KY (US)

( * ) Notice: Under 35 U.S.C. 154(b), the term of this patent shall be extended for 0 days.

(21) Appl. No.: 09/206,275

(22) Filed: Dec. 4, 1998

(51) Int. Cl.[7] ..... F28F 13/18; F28F 1/14; F28F 1/36

(52) U.S. Cl. ..... 165/133; 165/183; 165/184

(58) Field of Search ..... 165/133, 181, 165/183, 184

(56) References Cited

U.S. PATENT DOCUMENTS

| | | | | |
|---|---|---|---|---|
| 3,496,752 | * | 2/1970 | Kun et al. | 165/133 |
| 4,216,826 | * | 8/1980 | Fujikake | 165/133 |
| 4,402,459 | | 9/1983 | Berry | 239/186 |
| 4,660,630 | | 4/1987 | Cunningham et al. | 165/133 |
| 5,010,643 | | 4/1991 | Zohler | 29/890.048 |
| 5,052,476 | | 10/1991 | Sukumoda et al. | 165/133 |
| 5,054,548 | | 10/1991 | Zohler | 165/133 |
| 5,186,252 | * | 2/1993 | Nishizawa et al. | 165/184 |
| 5,259,448 | | 11/1993 | Masukawa et al. | 165/133 |
| 5,332,034 | * | 7/1994 | Chiang et al. | 165/184 |
| 5,458,191 | * | 10/1995 | Chiang et al. | 165/133 |
| 5,513,699 | | 5/1996 | Menze et al. | 165/133 |
| 5,669,441 | | 9/1997 | Spencer | 165/184 |
| 5,682,946 | | 11/1997 | Schmidt et al. | 165/133 |
| 5,697,430 | | 12/1997 | Thors et al. | 165/133 |
| 5,704,424 | | 1/1998 | Kohno et al. | 165/184 |

FOREIGN PATENT DOCUMENTS

| | | | | |
|---|---|---|---|---|
| 522985B1 | | 12/1996 | (EP) . | |
| 0083189 | * | 5/1983 | (JP) | 165/133 |
| 0165875 | * | 6/1990 | (JP) | 165/184 |
| 403207995 | * | 9/1991 | (JP) | 165/184 |
| 404339530 | * | 11/1992 | (JP) | 29/890.032 |

OTHER PUBLICATIONS

K, Menze, "Review of Patents in Europe, Japan, and the U.S.," (1993–1994), *J. of Enhanced Heat Transfer*, vol.3, No. 1, 1996, pp. 1–13.

* cited by examiner

*Primary Examiner*—Ira S. Lazarus
*Assistant Examiner*—Tho Duong
(74) *Attorney, Agent, or Firm*—Hodgson, Russ, Andrews, Woods & Goodyear, LLP

(57) ABSTRACT

A heat transfer tube having an inner surface provided with a dense pattern of polyhedrons having crack-like cavities on at least two surfaces of a single polyhedron, forming three-dimensional crack-like cavities that enhance flow evaporation heat transfer. The tube is made by (a) forming in an inner surface for the tube a plurality of generally parallel first grooves, (b) forming in the inner surface and over the first grooves a plurality of generally parallel second fins extending at a first angle of between 0 and about 25 degrees relative to a longitudinal axis for the tube to thereby devolve the second angle fins into the pattern of cavities, and (c) forming in the second fins a pattern of generally parallel crosshatches extending cross-wise thereto.

25 Claims, 5 Drawing Sheets

FIG. 10
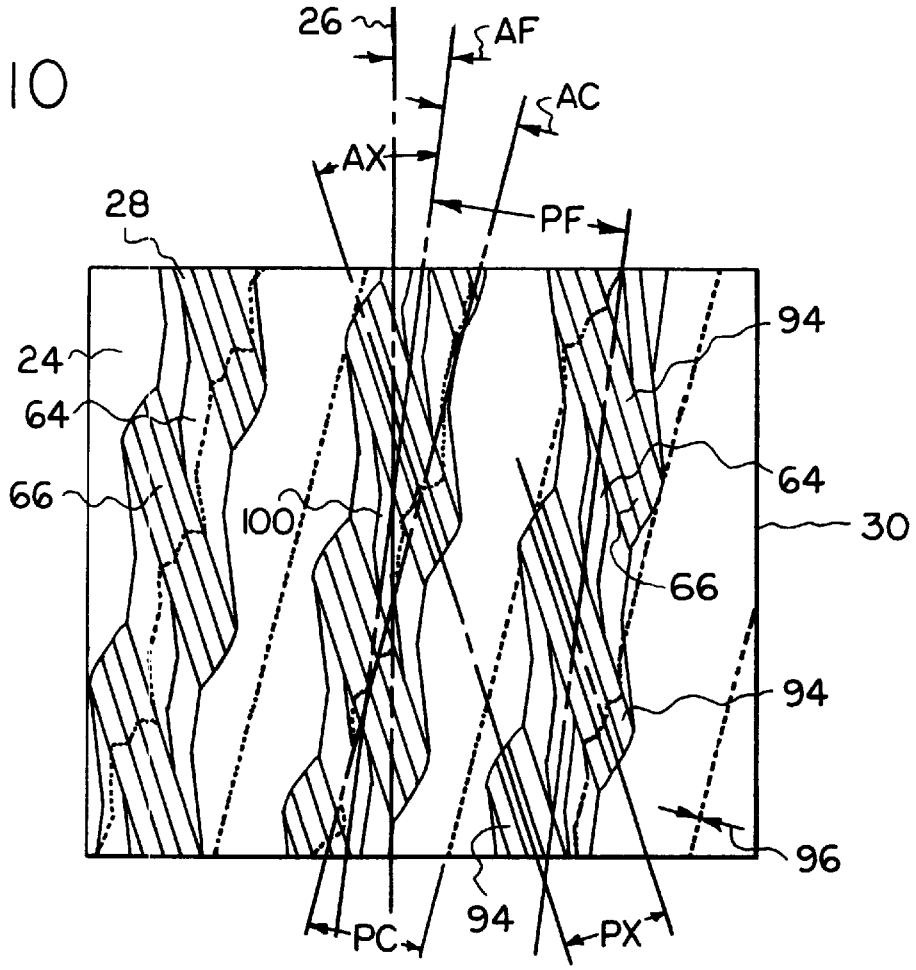
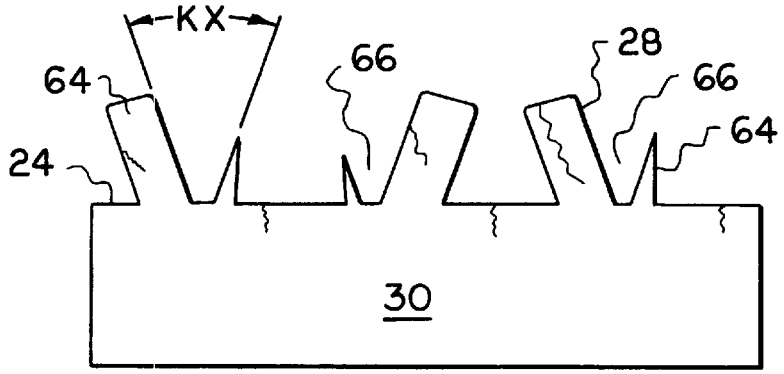
FIG. 9

HEAT TRANSFER TUBE WITH CRACK-LIKE CAVITIES TO ENHANCE PERFORMANCE THEREOF

FIELD OF THE INVENTION

The present invention relates generally to heat transfer tubes, and more particularly to a heat transfer tube having an internal surface which enhances the liquid-vapor two-phase flow heat transfer performance of the tube.

BACKGROUND OF THE INVENTION

In order to obtain increased two-phase flow heat transfer performance, heat transfer tubes have been provided with surface enhancements on their inner surfaces. The higher heat transfer performance of an internally enhanced tube as compared to a smooth tube can be utilized to reduce the size of heat exchangers which, in turn, provides the advantages of increased energy efficiency, reduced noise levels, and cost reductions in air conditioning and refrigeration equipment.

An early form of internally enhanced tube was the helical type which can be characterized as numerous continuous fins extending spirally along the tube axis. An example of such a helical tube is disclosed in U.S. Pat. No. 4,658,892. The fins typically are formed by an extrusion process and are substantially trapezoidal in cross-sectional shape with the larger end at the junction of the fin and the tube wall. This tube improves refrigerant evaporation heat transfer up to about two times that of the performance of a corresponding smooth tube. It also has one and one-half to two times the performance of the smooth tube in condensation. On the other hand, refrigerant flow pressure drop, which is not desired, is increased only about 30% to 50% in both evaporation and condensation.

Thereafter an axial internally enhanced tube was developed, which is a variation of the helical internally enhanced tube, with the helical angle of the fins being 0 degrees. This tube typically has more fins than the helical type and has more surface area. The axial internally enhanced tube has two-phase flow heat transfer performance similar to that of the helical tube in most practical flow rates, but provides significantly lower refrigerant pressure drop.

Crosshatch internally enhanced tubing is available currently in the air conditioning and refrigeration industry. It employs the axial or helical tube as its first enhancement and a cross notch of the continuous fins as the second enhancement to provide a relatively more complicated surface structure. Instead of continuous fins, like those in the helical and axial internally enhanced tubes, small segments of fins are provided on the tube inner surface. The crosshatch internally enhanced tube significantly increases condensation performance, i.e. about 35 percent, while providing a similar evaporation performance compared with the helical tube. The pressure drop of the crosshatch tube is slightly higher than that of the helical tube and significantly higher than that of the axial tube. Examples of crosshatch internally enhanced tubing are shown and described in U.S. Pat. Nos. 5,332,034 and 5,458,191.

SUMMARY OF THE INVENTION

It is known in the field of evaporation heat transfer that certain types of cavities on a heat transfer surface enhance evaporation so that the rate of heat transfer increases. This common knowledge was obtained from applications of pool boiling, in which the involvement of fluid flow is minimal. Thus, such knowledge leaves open the question of what will happen to a boiling liquid that has significant flow movement associated with it. It is therefore an objective of the present invention to answer the foregoing question and to provide tubes with improved flow evaporation heat transfer. As a result of the present invention, it is determined that surface cavities do help to enhance flow evaporation (boiling), and a cavity based enhanced heat transfer tube is developed.

The heat exchanger tube of the present invention has an internal surface that is formed to enhance the heat transfer performance of the tube, and in particular enhanced flow evaporation heat transfer. The internal enhancement has a plurality of polyhedrons extending from the inner wall of the tubing. The polyhedrons are arranged in polyhedral rows that are either substantially parallel to or disposed at an angle to the longitudinal axis of the tube. The polyhedrons have first and second planar faces that are disposed substantially parallel to the polyhedral rows. The polyhedrons have third and fourth faces disposed at an angle oblique to the direction of the polyhedral rows. The four faces of each polyhedron meet a fifth face spaced outwardly from the inner wall of the tubing. A single polyhedron has crack-like cavities on at least two of its faces, preferably three, which are not in the same geometrical plane and which cavities enhance flow evaporation heat transfer.

In order to achieve the foregoing surface enhancement, in accordance with the present invention, (1) a plurality of generally parallel first grooves are formed on the inner surface of the tube or what is to become the inner surface of the tube, (2) a plurality of generally parallel second fins extending at an angle relative to the first grooves of between about 2 and about 10 degrees and are formed in the inner surface, and (3) a pattern of generally parallel cuts are impressed into the second fins to extend cross-wise thereto. The formation of the second fins devolves the first grooves into the pattern of crack-like cavities. These continuous crack-like cavities are cut further into segments by the third enhancement step. The final surface has a dense array of polyhedrons having crack-like cavities on at least two surfaces of a single polyhedron, forming three-dimensional crack-like cavities that enhance flow evaporation heat transfer.

The prior art does not teach or suggest heat transfer tubing having an inner surface enhanced by polyhedrons having crack-like cavities on at least two surfaces which are not in the same geometrical plane and which cavities enhance flow evaporation heat transfer. U.S. Pat. No. 5,052,476 discloses a heat transfer tube having an inner surface in which are formed (1) U-shaped primary grooves which are parallel to one another and extending at an angle to the longitudinal direction of the heat transfer tube, and (2) V-shaped secondary grooves which are parallel to each other and which extend at an angle and intersecting with the primary grooves. As a result, pear shaped grooves are formed at the intersections of the primary and secondary grooves whose inner opening dimension is smaller than the dimension of the bottom of the pear-shaped groove. After the tube is formed, it may be expanded to narrow the opening of the secondary grooves and thereby introduce additional narrowing of the opening of the pear-shaped grooves located along the primary grooves. However, no crack-like cavities are formed.

U.S. Pat. No. 5,259,448 and the corresponding E.P. patent 0,522,985 disclose a heat transfer tube wherein (1) primary trapezoidal-shaped grooves are roll-formed parallel to one another on a metal strip surface (which will become the inner surface of the tube) and said to be desirably oriented less than 30 degrees from the tube axis, wherein (2) secondary trapezoidal-shaped grooves are roll-formed on the strip surface independent of the primary grooves and at the same angle, thereby inclining side faces of each primary groove closely toward the bottom face thereof, and forming a pair of sharp cuts between each of the side faces and the bottom face symmetrically, the strip then being rolled into a tube and the side edges joined to form a complete tube. After the strip is formed into a tube, an enlarging plug having a smooth periphery surface is inserted and drawn through the tube so that the heads of protruding portions between the main grooves are flattened. The cracks extend continuously only long the grooves or fins.

The above and other objects, features, and advantages of the present invention will be apparent to one of ordinary skill in the art to which this invention pertains from the following detailed description of the preferred embodiments thereof when taken in conjunction with the accompanying drawings wherein the same reference numerals or characters denote the same or similar parts throughout the several views.

BRIEF DESCRIPTION OF THE DRAWINGS

FIGS. 9 and 10 are views similar to those of FIGS. 4 and 5 respectively of the sheet portion after the pattern of FIG. 6 is enhanced by forming parallel cuts thereon.

DETAILED DESCRIPTION OF THE PREFERRED EMBODIMENTS

Figure 1:
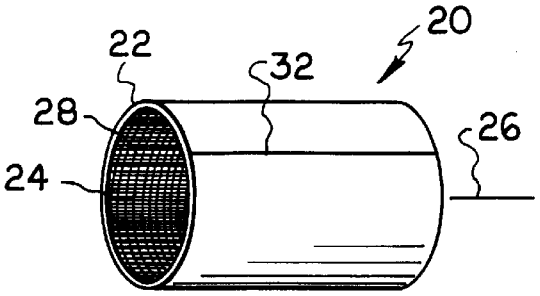
FIG. 1 is a perspective view of a portion of a tube which embodies the present invention.

Referring to FIG. 1, there is shown generally at 20 a portion of a tube, which may be composed of copper or other suitable material, used in, for example, heating or cooling systems for heat transfer between a fluid of one temperature flowing inside the tube and a fluid of a different temperature outside the tube. For example, boiling fluid can be flowing inside the tube 20. The tube 20 comprises a wall 22 having an inner surface 24 and a longitudinal axis 26. The inner surface 24 has a pattern according to the present invention, illustrated at 28, impressed, as described hereinafter, or otherwise suitably formed thereon in order to provide improved heat transfer, such as improved flow evaporation heat transfer.

Figure 2:
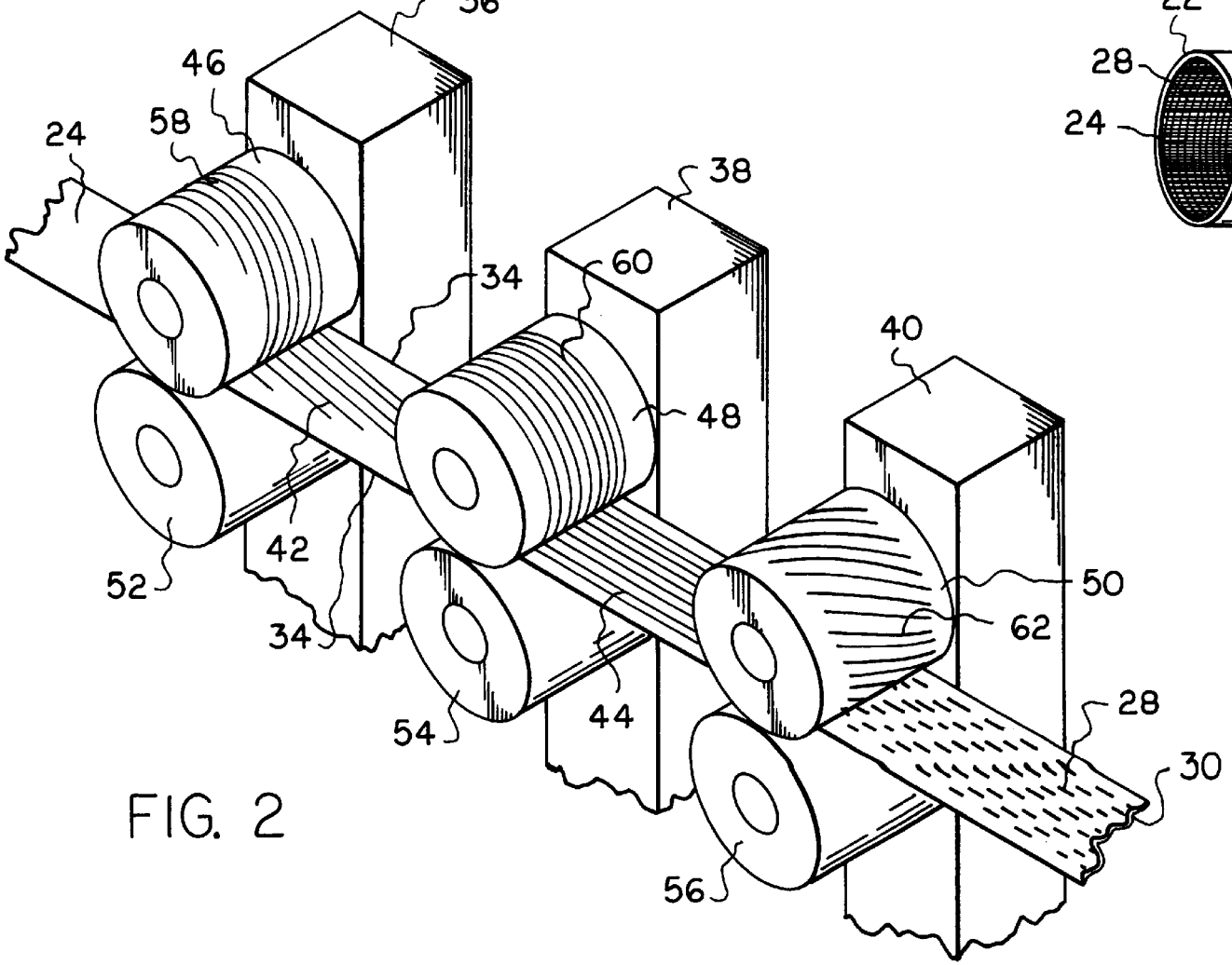
FIG. 2 is a schematic perspective view illustrating a method of forming the tube by impressing a pattern on a surface of a flat sheet before forming the flat sheet into the tube with the surface becoming the inner surface of the tube.
Figure 3:
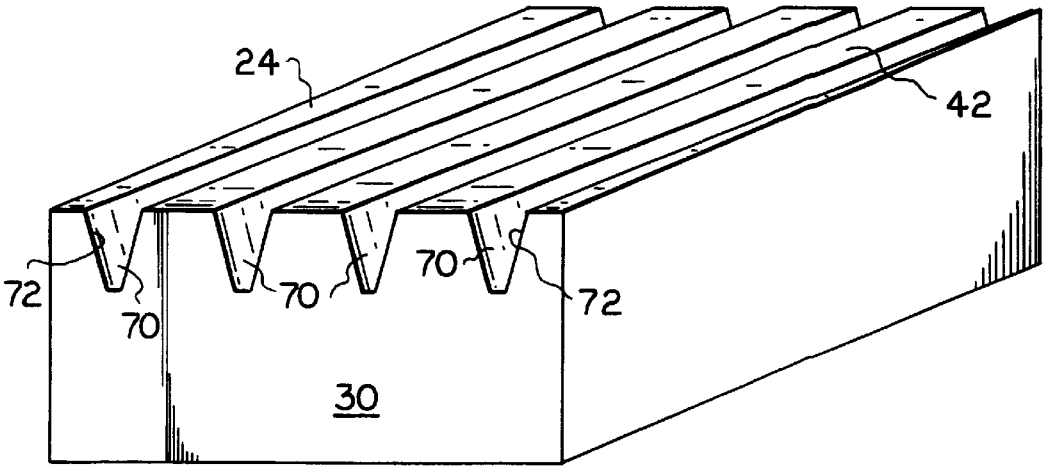
FIG. 3 is a perspective view of a portion of the flat sheet after a first pattern of first grooves are formed on the surface thereof.
Figure 4:
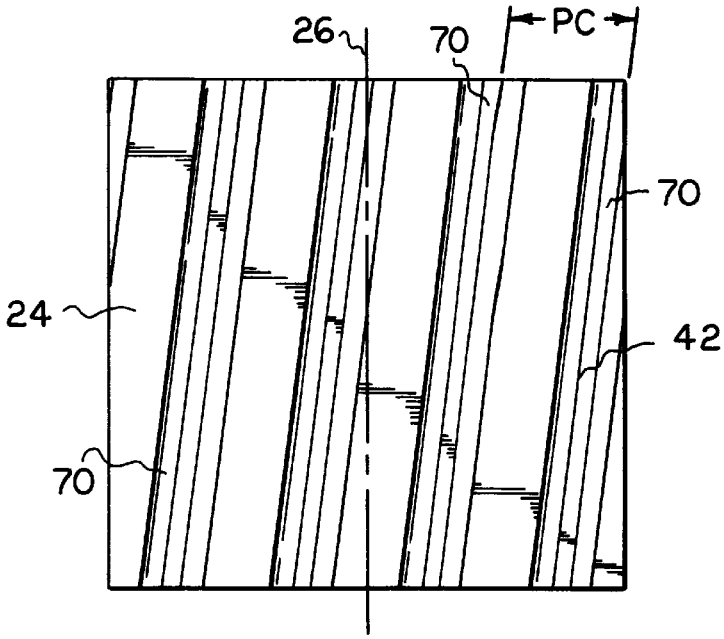
FIG. 4 is a plan view of the sheet portion of FIG. 3.
Figure 5:
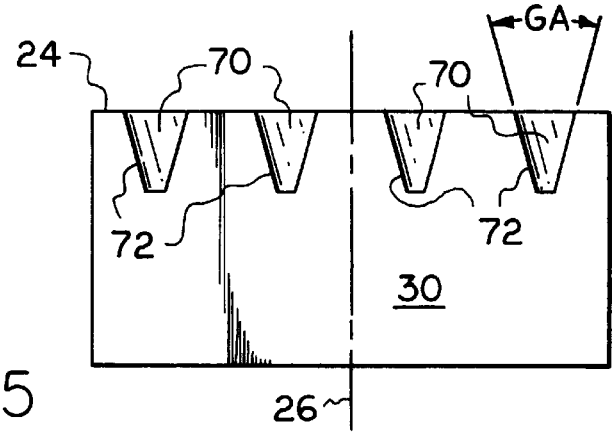
FIG. 5 is an end view of the sheet portion of FIG. 3.
Figure 6:
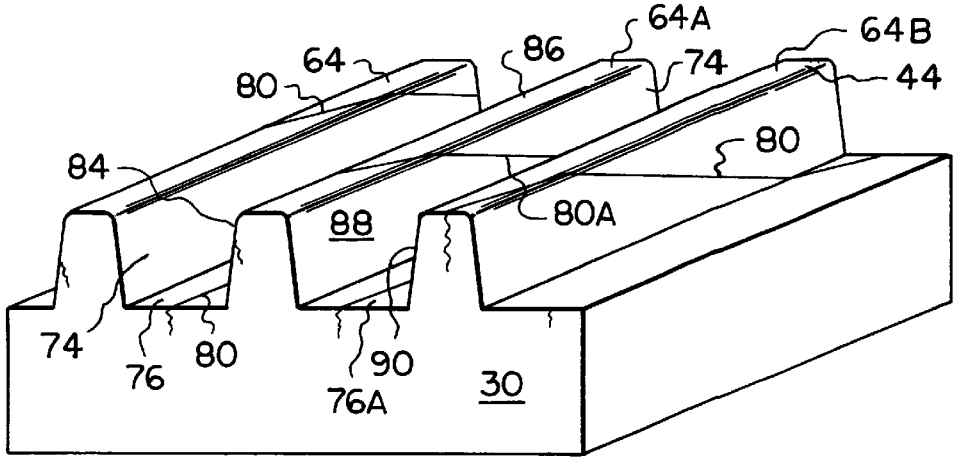
FIGS. 6, 7, and 8 are views similar to those of FIGS. 3, 4, and 5 respectively of the sheet portion after the pattern of FIG. 3 is enhanced by forming second fins thereon.
Figure 11:
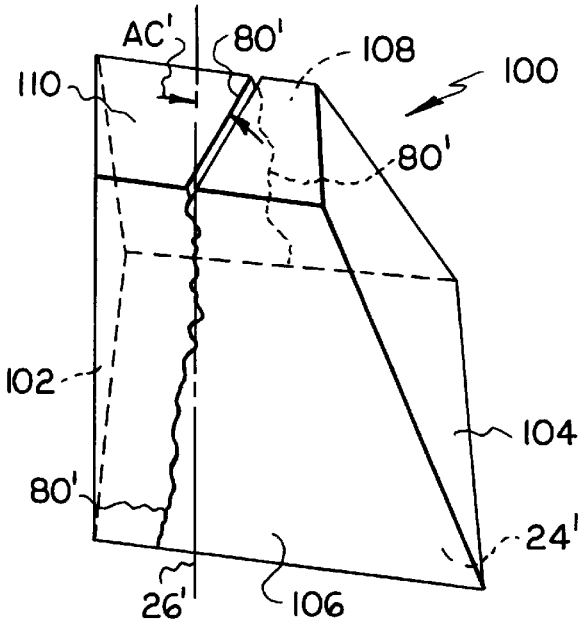
FIG. 11 is a perspective view of one of the polyhedrons of the surface enhancement illustrating the crack-like cavities according to the present invention.

The pattern 28, illustrated in FIGS. 9–11, may be formed on the inner surface 24 by any suitable process. In the manufacture of seam welded metal tubing using modern automated high speed processes, an effective method is to apply the pattern 28 by roll embossing on one surface of a metal strip, illustrated at 30 in FIG. 2, before the strip is roll formed into a circular cross section and seam welded, as illustrated at 32 in FIG. 1, into tube 20. Thus, the strip 30, after it is embossed, is welded along longitudinal edges 34 to form the seam 32. FIG. 2 illustrates the embossing process. Three roll embossing stations 36, 38, and 40 are positioned in the production line for forming or embossing first, second, and third enhancements or patterns 42, 44, and 28 respectively onto the surface 24 after which the strip 30 is conventionally roll formed into a tubular shape and seam welded into tube 20. The first station 42 receives the strip 30 in unworked form from a source of supply. The first pattern 42 is illustrated in FIGS. 3, 4, and 5. The second pattern 44 is illustrated in FIGS. 6, 7, and 8.

Each embossing station 36, 38, and 40 has a patterned enhancement roller 46, 48, and 50 respectively and a plain or unpatterned backing roller 52, 54, and 56 respectively. The backing and patterned rollers in each station are pressed together with sufficient force, by suitable conventional means (not shown) to cause, for example, patterned surface 58 on roller 46 to be impressed into the surface 24 of strip 30 thus forming enhancement pattern 42 on the strip 30. Patterned surface 58 is the mirror image of the pattern 42. Similarly, patterned surfaces 60 and 62 on rollers 48 and 50 are impressed onto the surface of strip 30 to form the enhancement patterns 44 and 28 on the strip 30. Patterned surface 62 on roller 50 has a series of raised projections that press into fins 64 (see FIGS. 6, 7, and 8) formed by patterned surface 60 and form the notches, illustrated at 66 (see FIGS. 9–11) in the ribs 64 in the finished tube 20, as described in greater detail hereinafter. It should be noted that the roller 48 forms its enhancement pattern onto the enhancement pattern 42 thus changing pattern 42 into a different pattern 44, and, likewise, the roller 50 forms its enhancement pattern onto the enhancement pattern 44 thus changing pattern 44 into a different pattern 28.

If the tube 20 is manufactured by roll embossing, roll forming, and seam welding, as described above, it is likely that there will be a small region along the line of the weld 32 in the finished tube 20 that either lacks the enhancement pattern 28 that is present around the remainder of the tube circumference, due to the nature of the manufacturing process, or may have a different enhancement configuration. This small region of different configuration should not adversely affect the thermal or fluid flow performance of the tube in any significant way.

Figure 7:
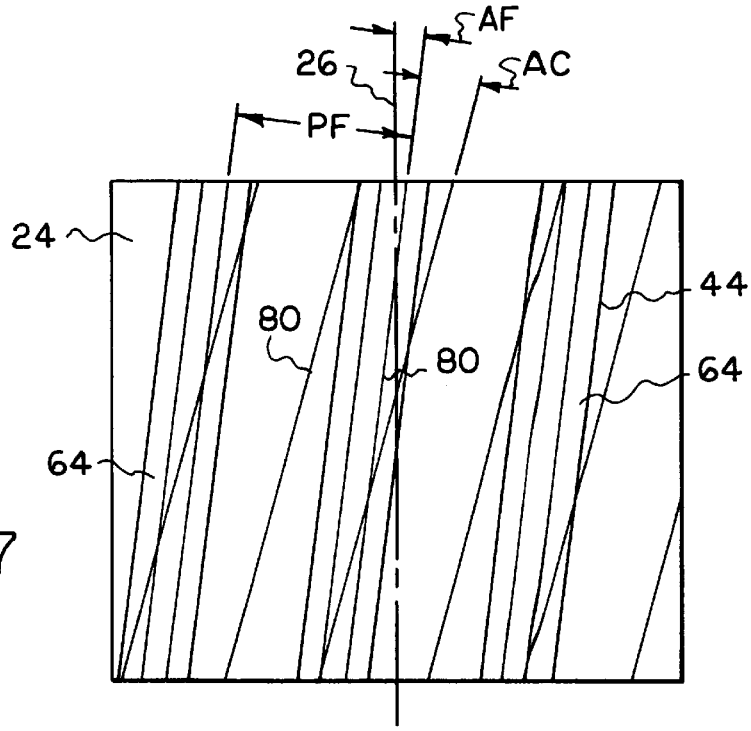
Figure 8:
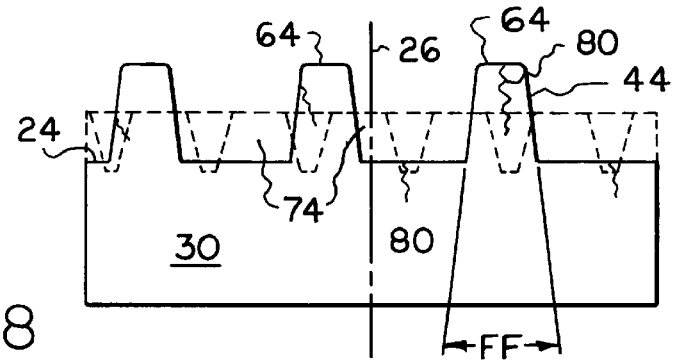

Referring to FIGS. 3–5 and 7, the first pattern 42 comprises a plurality of parallel first grooves 70 impressed or otherwise suitably formed in the inner surface 24 at an angle, illustrated at AC in FIG. 7, relative to the direction in which the second fins 64 extend. Angle AC, which will be described in greater detail hereinafter, is in the range of about 2–10 degrees. The pitch PC shown in FIG. 3 has a desired range of about 0.006 to about 0.02 inch (preferably about 0.008 to about 0.01 inch such as, for example, 0.0081 inch). The first enhancement or pattern 42 is formed by rollers 46, 52 of FIG. 2.

Referring to FIGS. 6, 7, and 8, the second pattern 44 comprises the plurality of parallel second fins or ribs 64 impressed or otherwise formed in the inner surface 24 (including forming over the first pattern 42 or first grooves 70) to extend at a first angle, illustrated at AF, of between 0 and about 25 degrees relative to the longitudinal axis 26. Grooves, illustrated at 74, having lower surfaces or floors 76 are defined between the fins 64. Grooves 74 may be otherwise suitably shaped. The second enhancement or pattern 44 is formed by rollers 48, 54 of FIG. 2. The pitch PF is in the desired range of about 0.011 to 0.037 inch (preferably about 0.015 to 0.022 inch such as, for example, about 0.0153 inch).

Dashed lines in FIG. 8 illustrate the first pattern 42 before the second enhancement. FIG. 8 illustrates that the first pattern 42 of grooves 70 have devolved into a pattern of continuous crack-like cavities, illustrated at 80. Since these cavities, having devolved from a squeezing or deforming of the first grooves 70, will extend at the angle AC at which the first grooves extended, which is different from the angle AF at which the second fins 64 extend, each cavity, such as cavity 80A, will resultingly extend at an angle to the direction in which the second fins 64A extend and will therefore extend along a side, as at 84, then along the apex, as at 86, then along the other side, as at 88, of a second fin 64A, then along the adjacent groove floor 76A, then along the side, as at 90, of the next adjacent second fin 64B, etc. Thus, the cavities 80, extend alternately along both "hills" (such as apex 86) and "valleys" (groove floors 76). The cavities 80 provide increased nucleation sites to achieve increased heat transfer.

The first grooves 70 desirably extend at an angle, illustrated at AC, relative to the direction that the second fins 64 extend, in the range of about 2 to 10 degrees (preferably about 5 to 7 degrees).

Referring to FIGS. 9 and 10, the third enhancement comprises the pattern of generally parallel cuts 66 impressed into the second fins 64 cross-wise thereto at an angle, illustrated at AX, which is desirably between about 5 and 90 degrees in opposite hand side or opposed to the angle AF. Therefore, the angle AX is preferably between about 10 and 45 degrees, typically about 25 degrees, in opposite hand side (opposed) to the angle AF. The cross-hatching with the cuts 66 is provided to form polyhedrons 100, one of which is illustrated in FIG. 11. Since this distorts the cavity path even more, as also seen in FIG. 10, the cavity length is further increased for added cavity exposure for even greater effective heat transfer. The third enhancement is formed by rollers 50, 56 in FIG. 2.

The first enhancement groove angle, illustrated at GA in FIG. 5, is between about 10 and 90 degrees, preferably between about 20 and 45 degrees such as, for example, about 30 degrees.

The second enhancement fin angle, illustrated at FF in FIG. 8, is between about 5 and 45 degrees, preferably between about 15 and 30 degrees such as, for example, about 15 degrees.

The third enhancement cut pitch, illustrated at PX in FIG. 10, is between about 0.006 and 0.02 inch, preferably between about 0.008 and 0.01 inch such as, for example, about 0.0081 inch.

The third enhancement cut angle, illustrated at KX in FIG. 9, is between about 10 and 90 degrees, preferably between about 20 and 45 degrees such as, for example, about 30 degrees.

As previously described, the foregoing three enhancements result in a plurality of polyhedrons extending from surface 24. The polyhedrons are arranged in polyhedral rows extending substantially parallel to, or extending at an angle to, the longitudinal axis of the heat transfer tube 20, and one such polyhedron 100 is shown in FIG. 11. Each polyhedron has first and second substantially planar faces 102 and 104 which are disposed substantially parallel to the direction of the polyhedral rows. Faces 102 and 104 are opposite each other and preferably slightly inclined relative to each other with an included angle FF shown, for example, in FIG. 8. Each polyhedron 100 also has third and fourth substantially planar faces 106 and 108 which are disposed at an oblique angle AX shown in FIG. 10 relative to the direction of the polyhedral rows. Faces 106 and 108 are opposite each other and preferably slightly inclined relative to each other with an included angle KX shown, for example, in FIG. 9. The four faces 102, 104, 106 and 108 of each polyhedron 100 meet an outer or top face 110 which is spaced outwardly from tubing surface 24". Surfaces 102 and 104 of each polyhedron 100 are formed in the second step (finning) of the process previously described, i.e. the second enhancement. Surfaces 106 and 108 of each polyhedron 100 are formed in the third step (cross-hatching) of the process, i.e. the third enhancement.

FIG. 11 shows one illustrative polyhedron 100, and the crack-like cavity 80' is shown in the present illustration on faces 106, 110 and 108. Cavities like cavity 80' are on at least two of the faces of polyhedrons like polyhedron 100 which faces are not in the same geometrical plane. Thus the cavities 80' are segmentational. In the illustration of FIG. 11 the cavity 80' is on three faces. The cavities 80' not only appear in the geometrical plane parallel to the tube inner surface 24', but also appear in the planes perpendicular to tube inner surface 24. Therefore, the cavity 80' may be viewed as being three dimensional since it extends along surfaces not in the same geometrical plane. The shape angles between portions of cavity 80' on adjacent faces of polyhedron 100 is at least 90 degrees. Another way of viewing each three dimensional crack-like cavity 80' is that there is only one cavity 80' on a polyhedron but that the cavity 80' has at least two and preferably three openings or exits on as many different surfaces. The previously described angle AC' is measured in FIG. 11 between tube axis 26' and the crack-like cavity 80 on top or outer surface 110.

The crack-like cavities 80' are on at least two of the polyhedron faces, and in the illustration of FIG. 11 cavity 80' is on faces 106, 110 and 108. Due to the effect of the angle between the first and second enhancements previously described, other possibilities include the cavity on faces 102 and 108, on faces 102, 110 and 108, on faces 106, 110 and 104 and on faces 106 and 104. Whether a cavity is on two or three faces of a polyhedron 100, and the particular faces on which the cavity is located, are determined by the location of a particular polyhedron 100 in the array or pattern. This is because of the angle between the first and second enhancements previously described. Furthermore, not all polyhedrons 100 will contain crack-like cavities 80'. However, according to a preferred mode of the present invention, the density of polyhedrons with crack-like cavities on at least two faces of the body of each polyhedron is at least 1700 per square inch, preferably greater than 3500 per square inch. By way of further illustration, considering polyhedron 100 shown in FIG. 11 with cavity 80' on faces 106, 110 and 108, due to the effect of the angle between the first and second enhancements, a cavity on faces 102 and 108 is likely for another polyhedron located relatively close in the same polyhedral row relative to polyhedron 100 of FIG. 11, and a cavity on faces 106 and 104 is likely for another polyhedron located farther away in the same polyhedral row relative to polyhedron 100 of FIG. 11.

The density of polyhedrons is desirably at least about 3500 per square inch, preferably greater than 5000 per square inch such as, for example, greater than 7280 per square inch.

The density of polyhedrons with cavities on them is desirably at least about 1700 per square inch, preferably greater than 2500 per square inch such as, for example, greater than 3500 per square inch.

The cavity opening width, illustrated at 96 in FIG. 10, is desirably at least about 0.0001 inch, preferably between about 0.0002 and 0.001 inch such as, for example, about 0.0005 inch.

Figure 12:
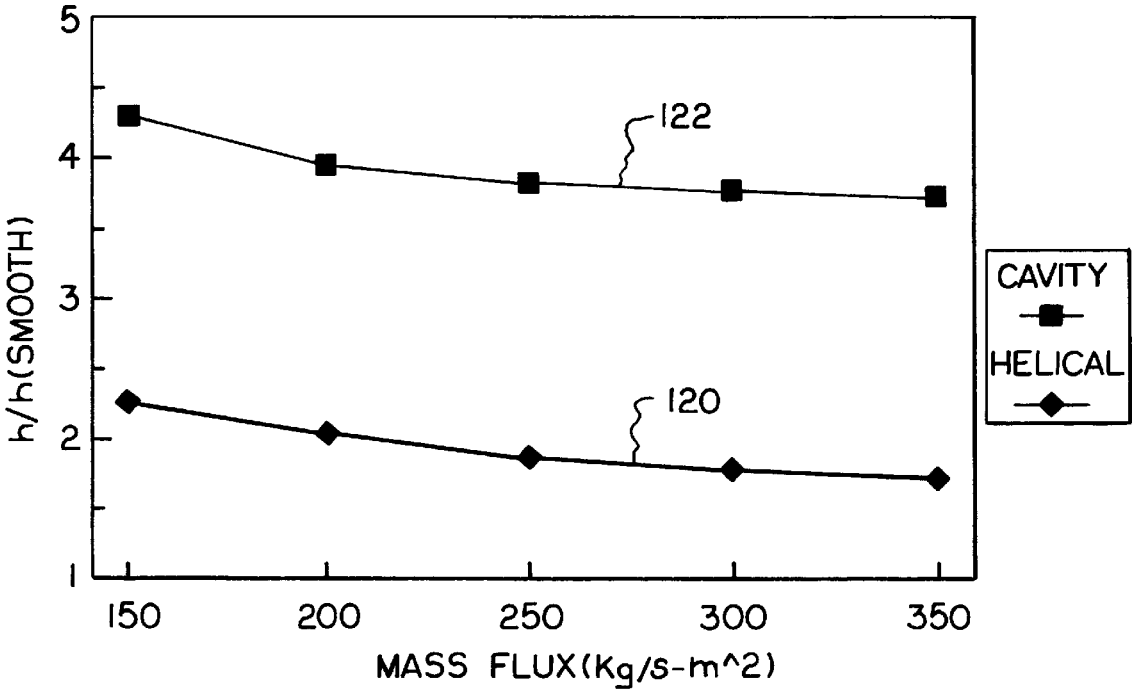
FIG. 12 is a graph of evaporation enhancement provided by a prior art helical tube and by a cavity enhanced tube according to the present invention.

FIG. 12 is a graph of heat transfer enhancement vs. refrigerant flow rate to illustrate evaporation enhancement of a prior art internally enhanced tube of the helical type shown by curve 120 and a crack-like cavity enhanced tube of the present invention shown by curve 122. Heat transfer enhancement is defined by the ratio of the heat transfer coefficient of an enhanced tube over the heat transfer coefficient of a smooth tube. The prior art helically enhanced tube represented by curve 120 is similar to the tube disclosed in U.S. Pat. No. 4,658,892. The cavity enhanced tube of the present invention demonstrated a greater evaporation heat transfer enhancement over the entire range of flow rate investigated.

Thus, there is provided a tube inner surface pattern or array of polyhedrons having three dimensional crack-like cavities for improved flow evaporation heat transfer. The heat transfer performance of the cavity enhanced tube of the present invention shows significant increase in both evaporation and condensation. In evaporation, the cavity enhanced tube of the present invention is approximately 30% to 90% better in heat transfer performance, depending on heat flux level and refrigerant flow rate, than the prior art helical tube. In condensation, the cavity enhanced tube of the present invention is approximately 30 to 70% better than the prior art helical tube. On the other hand, the refrigerant pressure drop with the cavity enhanced tube of the present invention is the same as that of the prior art crosshatch tube.

It should be understood that, while the present invention has been described in detail herein, the invention can be embodied otherwise without departing from the principles thereof, and such other embodiments are meant to come within the scope of the present invention as defined by the appended claims.

What is claimed is:

1. A heat transfer tube for conveying a flow of a heat transfer substance in a flow direction, the heat transfer tube, comprising:

a tubular member having an inner surface defining an inner diameter and having a longitudinal axis; and a plurality of polyhedrons formed on the inner surface, the polyhedrons having four sides which meet an outer surface, the polyhedrons disposed in polyhedral rows extending along said inner surface, the polyhedrons having first and second faces opposed to each other and extending substantially parallel to the polyhedral rows, the polyhedrons having third and fourth faces opposed to each other and disposed at an angle oblique to the polyhedral rows, the first, second, third and fourth faces meeting an outer face, and crack-like cavities on at least two faces of a polyhedron which cavities are not in the same geometric plane and which cavities enhance flow evaporation heat transfer, the third face of the polyhedron having at least one of the crack-like cavities and being disposed such that it is facing in the flow direction to enhance nucleation.

2. A heat transfer tube according to claim 1, wherein said polyhedral rows extend substantially parallel to the longitudinal axis.

3. A heat transfer tube according to claim 1, wherein said polyhedral rows extend at an angle to the longitudinal axis.

4. A heat transfer tube according to claim 1, wherein crack-like cavities are on at least two faces of a polyhedron.

5. A heat transfer tube according to claim 1, wherein crack-like cavities are on three faces of a polyhedron.

6. A heat transfer tube according to claim 1, wherein the polyhedrons have a density of at least 1700 per square inch.

7. A heat transfer tube according to claim 6, wherein said density is greater than 3500 per square inch.

8. A heat transfer tube for conveying a flow of a heat transfer substance in a flow direction, the heat transfer tube comprising a wall having an inner surface and a longitudinal axis, a plurality of generally parallel fins formed in said inner surface and extending at a first angle of between 0 and about 25 degrees relative to said longitudinal axis, a pattern of generally parallel crosshatches formed in said fins and extending cross-wise thereto, and a pattern of crack-like cavities in said inner surface including said fins and extending generally at a second angle of between about 2 and 10 degrees relative to said fins, the crack-like cavities disposed on one of the crosshatches such that at least one portion of the crack-like cavity is facing in the flow direction to enhance nucleation.

9. A tube according to claim 8 made by forming in said inner surface a plurality of generally parallel grooves extending at said second angle, forming in said inner surface and over said second angle grooves a plurality of said first angle fins to thereby devolve said second angle grooves into said pattern of cavities, and forming said pattern of parallel notches in said first angle fins.

10. A tube according to claim 8 wherein said first angle is between 0 and about 25 degrees relative to said longitudinal axis.

11. A tube according to claim 8 wherein said crosshatches extend at an angle of between about 5 and 90 degrees relative to said fins, in opposite hand side thereof.

12. A tube according to claim 8 wherein said first angle is about 0 degrees relative to said longitudinal axis.

13. A tube according to claim 12 wherein said second angle is between about 2 and 7 degrees relative to said fins.

14. A tube according to claim 13 wherein said crosshatches extend at an angle of about 25 degrees relative to said fins, in opposite hand side thereof.

15. A tube according to claim 8 wherein said fins have a fin angle of between about 15 and 30 degrees.

16. A tube according to claim 8 wherein said cavities have an opening width of at least about 0.0001 inch.

17. A tube according to claim 8 wherein said cavities have an opening width of between about 0.0002 and 0.001 inch.

18. A method of forming a heat transfer tube for conveying a flow of a heat transfer substance in a flow direction comprising the steps of (a) forming in an inner surface for the tube a plurality of generally parallel first grooves, (b) forming in the inner surface and over the first grooves a plurality of generally parallel second fins extending at a first angle of between 0 and about 25 degrees relative to a longitudinal axis for the tube, and (c) forming in the second fins a pattern of generally parallel crosshatches extending cross-wise thereto, and wherein the step of forming the first grooves includes forming the first grooves to extend at a second angle of between about 2 and 10 degrees relative to the second fins, whereby the crack-like cavities are disposed on one of the crosshatches such that at least one portion of the crack-like cavity is facing in the flow direction to enhance nucleation.

19. A method according to claim 18 wherein the first grooves and second fins and the notches are formed on a flat sheet, the method further comprising forming the flat sheet into a tube.

20. A method according to claim 18 further comprising selecting the first angle to be between 0 and about 18 degrees relative to the longitudinal axis.

21. A method according to claim 18 further comprising selecting the angle at which the notches extend to be between about 10 and 45 degrees relative to the second fins, in opposite hand side thereof.

22. A method according to claim 18 further comprising selecting the first angle to be about 0 degrees relative to the longitudinal axis.

23. A method according to claim 22 further comprising selecting the second angle to be between about 5 and 7 degrees relative to the second fins.

24. A method according to claim 23 further comprising selecting the angle at which the crosshatches extend to be about 25 degrees relative to the second fins, in opposite hand side thereof.

25. A method according to claim 18 further comprising forming the first grooves to have a groove angle of between about 20 and 45 degrees.

* * * * *